US005272485A

United States Patent [19]

Mason et al.

[11] Patent Number: 5,272,485

[45] Date of Patent: Dec. 21, 1993

[54] MICROSTRIP ANTENNA WITH INTEGRAL LOW-NOISE AMPLIFIER FOR USE IN GLOBAL POSITIONING SYSTEM (GPS) RECEIVERS

[75] Inventors: Stanley L. Mason, San Jose; Eugene Tom, San Francisco; Arthur N. Woo, Cupertino, all of Calif.

[73] Assignee: Trimble Navigation Limited, Sunnyvale, Calif.

[21] Appl. No.: 830,738

[22] Filed: Feb. 4, 1992

[51] Int. Cl.[5] ..... H01Q 23/00; H01Q 1/38

[52] U.S. Cl. ..... 343/700 MS; 343/850

[58] Field of Search ..... 343/700 MS, 850, 852, 343/701, 702, 853

[56] References Cited

U.S. PATENT DOCUMENTS

| | | | |
|---|---|---|---|
| 3,984,834 | 10/1976 | Kaloi | 343/700 MS |
| 4,853,703 | 8/1989 | Murakami et al. | 343/700 MS |
| 5,083,132 | 1/1992 | Kanda et al. | 343/700 MS |

FOREIGN PATENT DOCUMENTS

| | | | |
|---|---|---|---|
| 0015905 | 1/1987 | Japan | 343/700 MS |
| 0154607 | 6/1989 | Japan . | |

OTHER PUBLICATIONS

D. F. Bowman Impedance Matching and Broadbanding, Chapter 43 of the Antenna Engineering Handbook 1984, McGraw-Hill, New York, pp. 43-1 to 43-32.

*Primary Examiner*—Rolf Hille
*Assistant Examiner*—Peter Toby Brown
*Attorney, Agent, or Firm*—Thomas E. Schatzel

[57] ABSTRACT

An embodiment of the present invention is a diagonally fed electric microstrip RHP antenna having a ceramic substrate, a groundplane on one side of the substrate, a rectangularly-shaped radiator attached to the other side of the substrate, and a via that passes through the substrate and connects to a point on the radiating electrode that provides a predetermined impedance $Z_o$, the via has an inductance $L_{via}$ such that an optimum impedance for a minimum noise figure $\Gamma_o$ is presented to the opposite end of the via. A groundplane relief in the first side of the dielectric substrate allows an active device to be connected to the second end of the via and placed within the groundplane relief. An output matching network also inside the groundplane relief is used for coupling the active device to an external system, such as a Global Positioning System (GPS) receiver.

11 Claims, 3 Drawing Sheets

MICROSTRIP ANTENNA WITH INTEGRAL LOW-NOISE AMPLIFIER FOR USE IN GLOBAL POSITIONING SYSTEM (GPS) RECEIVERS

BACKGROUND OF THE INVENTION

1. Field of the Invention

The invention relates generally to diagonally fed electric microstrip dipole antennas and specifically to such antennas where the feedpoint and via inductance are used to provide a low noise amplifier with the optimum impedance for minimum noise figure (Γb).

2. Description of the Prior Art

FIG. 1 shows a conventional system 10 with a Global Positioning System (GPS) antenna 12, a cable 14, and a low-noise amplifier (LNA) 16 in a typical configuration where the coaxial cable 14 (with a loss equal to Lc) links microstrip antenna 12 (with a feedpoint and via inductance having an optimum noise figure source impedance (Γs) equal to zero) to the LNA 16 having an input loss (Linput of $Lc+L_{imn}$). A fifty ohm match is made possible by an input matching network (IMN) 18 which drives an active device 20 and an output match network (OMN) 22. The noise figure (NF) contribution of the cable and IMN 18 is given by the available gain of the cable 14 and IMW 18.

The input loss of the cable 14 and IMN 18 add directly to the NF of the system $F_{sys}$.

$$F_{sys} = L_c L_{IMN}\left(F_{LNA} + \frac{F_{ROA} - 1}{G_{LNA}}\right). \tag{2}$$

where $F_{ROA}$=NF of the rest of the GPS receiver following LNA 16.

As the present invention does, incorporating LNA 16 in antenna 12 and repositioning cable 14 will reduce the system NF by the amount of input loss, if $G_{LNA} >> L_c L_{IMN}$.

$$F_{sys}' = F_{LNA} + \frac{F_{ROA} - 1}{G_{LNA}}. \tag{3}$$

The NF reduction is then, $$F_{sys} - F_{sys} = L_c L_{IMN}. \tag{4}$$

A diagonally fed electric microstrip antenna is described by Kaloi in U.S. Pat. No. 3,984,834, issued Oct. 5, 1976. The feedpoint is located along a diagonal with respect to the rectangular antenna element on a dielectric substrate. This particular point of feed is said by Kaloi to cause the antenna to operate in a degenerate mode where two oscillations occur at the same frequency. These oscillations occur along the X axis and the Y axis. The respective axis dimensions determine the resonant frequencies of each. Design equations for this type of antenna are presented by Kaloi, and so are not repeated here.

The feedpoint of a diagonally fed electric microstrip antenna can be chosen to present a particular impedance, for example fifty ohms. However, such a point may not be the point that produces a minimum of noise. Therefore, a diagonally fed electric microstrip antenna with a minimum noise feedpoint and an integrated LNA is needed to permit the reliable operation of high performance systems, such as personal, hand-held GPS receivers.

SUMMARY OF THE PRESENT INVENTION

It is therefore an object of the present invention to improve the reception of signals from GPS satellites.

Briefly, an embodiment of the present invention is a diagonally fed electric microstrip antenna having a ceramic substrate, a groundplane on one side of the substrate, a rectangularly-shaped radiator attached to the other side of the substrate, and a via that passes through the substrate and connects to a point on the radiating electrode that provides a predetermined impedance $Z_o$, the via has an inductance $L_{via}$ such that an optimum impedance for a minimum noise figure $\Gamma_o$ is presented to the opposite end of the via. A groundplane relief on the first side of the dielectric substrate allows an active device to be connected to the second end of the via and placed within the groundplane relief. An output matching network also inside the groundplane relief is used for coupling the active device to an external system, such as a Global Positioning System (GPS) receiver.

An advantage of the present invention is that losses in an active device's input matching network are eliminated because the network itself is eliminated.

Another advantage of the present invention is that noise factor (NF) degradation due to cable loss is eliminated.

Another advantage of the present invention is that the via to the feedpoint on a radiator provides the inductance needed to connect to the Γo point of optimum low noise.

These and other objects and advantages of the present invention will no doubt become obvious to those of ordinary skill in the art after having read the following detailed description of the preferred embodiments which are illustrated in the various drawing figures.

IN THE DRAWINGS

DETAILED DESCRIPTION OF THE PREFERRED EMBODIMENTS

Figure 1:
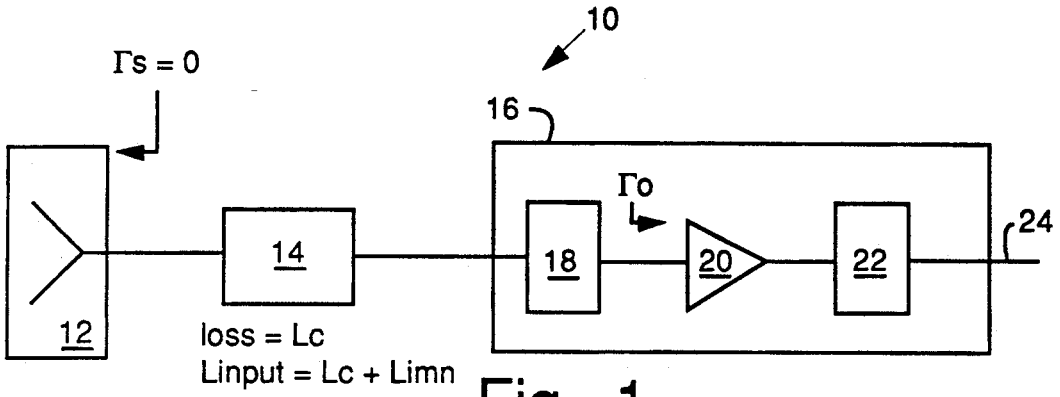
Fig. 1 (prior art)
FIG. 1 is a block diagram of a prior art microstrip antenna connected through a cable to a low-noise amplifier.
Figure 2:
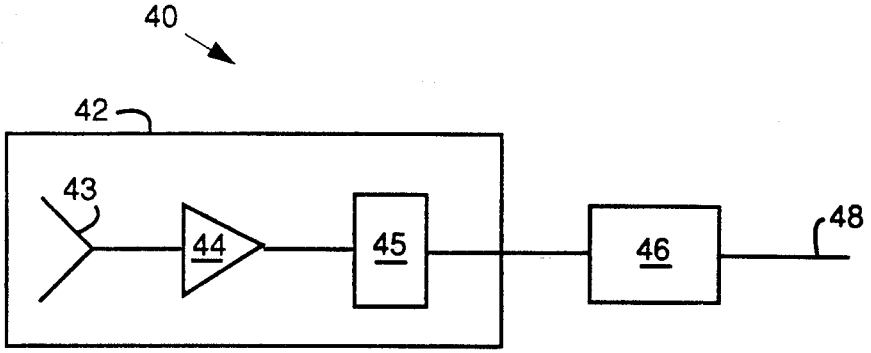
FIG. 2 is a block diagram of microstrip antenna and an integrated low-noise amplifier, according to an embodiment of the present invention.

In FIG. 2, a system 40, according to a first embodiment of the present invention, comprises an integrated assembly 42 having a microstrip antenna 43, an active device 44, and an output matching network 45. A cable 46 couples assembly 42 to an external system at port 48.

The external system can be a receiver, such as a GPS receiver, or a transmitter, in which case active device 44 would drive antenna 43 and $\Gamma_L$=optimum load for maximum power. The connection between antenna 43 and active device 44 is at a point of predetermined impedance $Z_o$, the connection has an inductance $L_{via}$ such that an optimum impedance for a minimum noise figure $\Gamma_o$ is present at the input of active device 44. A GaAs FET transistor can be used for active device 45. Other high-gain, low-noise transistors can also be used with good results.

Figure 3A:
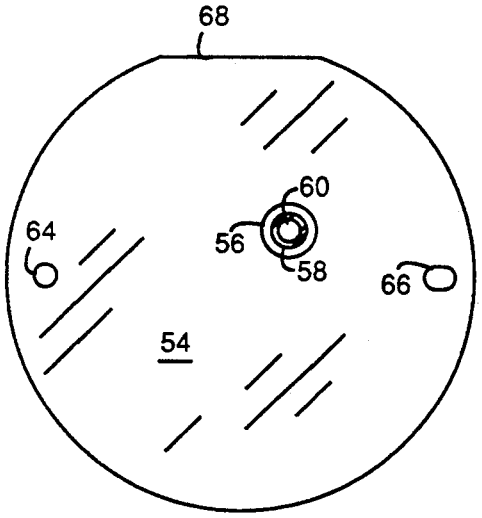
FIGS. 3A through 3C are a bottom, groundplane view; an edge view; and a top, radiator view, respectively, of a microstrip antenna, according to an embodiment of the present invention.
Figure 3B:
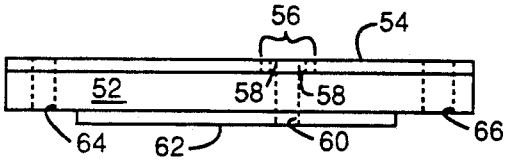
Figure 3C:
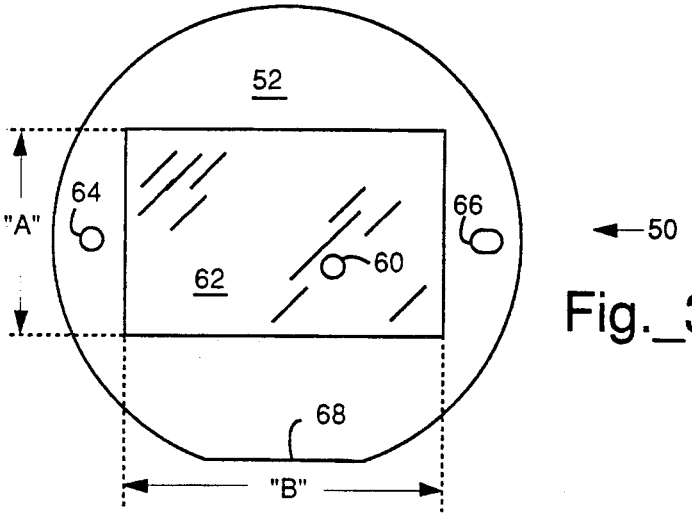

FIGS. 3A-3C show a second embodiment of the present invention, which is a microstrip antenna 50 comprising a ceramic substrate 52, a first metal layer 54 that completely covers one side of microstrip antenna 50 except for an opening 56 which encircles a metal annular ring 58 in contact with a plated-through hole (via) 60. Microstrip antenna 50 further comprises a second metal layer 62 having a rectangular shape of dimensions "A" by "B" and that is tapped by via 60. A hole 64 and a slot 66 allow microstrip antenna 50 to be mounted to a surface with common fasteners. Microstrip antenna 50 is generally a round disk in shape, but has a flat edge 68 for orientation. The dimensions "A" and "B", their ratio to one another, and the thickness and dielectric constant of substrate 52 will determine the resonant frequency, and therefore the frequency of operation for microstrip antenna 50. Such a determination, however, is conventional, and one skilled in the art will be able to pick a frequency of operation and to determine the appropriate dimensions "A" and "B".

The first metal layer 54 is alternatively referred to herein as a groundplane and second metal layer 62 is alternatively referred to herein as a radiating element.

Figure 4A:
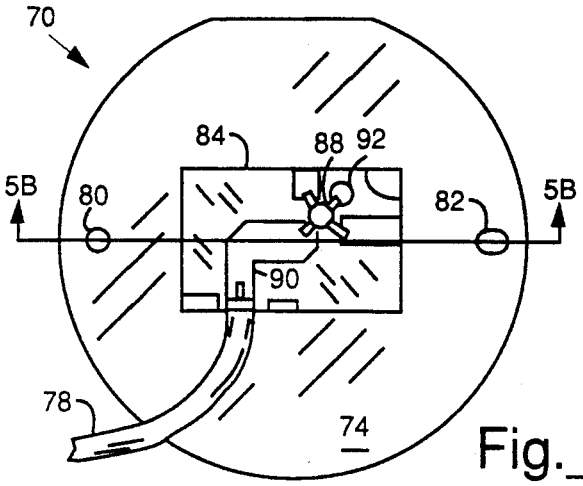
FIGS. 4A and 4B are a bottom, groundplane view and an edge view, respectively, of the microstrip antenna and integrated low-noise amplifier of FIG. 2.
Figure 4B:
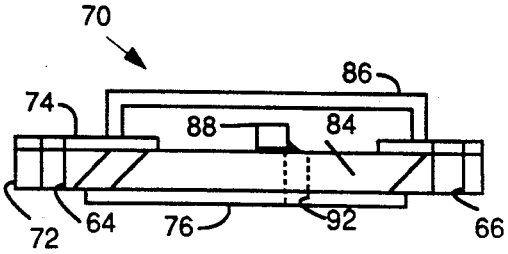

In FIGS. 4A and 4B, a third embodiment of the present invention is shown and is a pre-amplified antenna 70 comprising dielectric substrate 72, a groundplane 74, a radiator 76, an interconnect cable 78, a round mounting hole 80, an elongated mounting hole 82, a groundplane relief 84, a groundplane relief lid 86, and an active device 88. An output matching network (OMN) 90 couples active device 88 to cable 78. A via 92 couples active device 88 to a point of predetermined impedance $Z_o$. Via 92 has an inductance $L_{via}$ a such that an optimum impedance for a minimum noise figure $\Gamma_o$ is present at the input of active device 88. The geometry of via 92 is adjusted to modify the inductance and the X-Y coordinate point in radiator 76 is adjusted to modify the impedance Zo. Impedances of fifty ohms are common in the industry. Without the conductive attachment of conductive lid 86, the relief of groundplane relief 84 in groundplane 74 would lower the antenna resonant frequency. Lid 86 functions as an RF shield to eliminate positive feedback from the active device 88 through antenna 70 and it minimizes the detuning effects of the hole in groundplane 74 by restoring a more direct path for antenna ground current to flow.

Although the third embodiment is described herein as a pre-amplifier, the general construction strategy shown here can be successfully employed to produce a high-performance transmitter antenna. In such a case, the output of active device 88 would drive via 92 and cable 78 is connected to a transmitter.

Figure 5A:
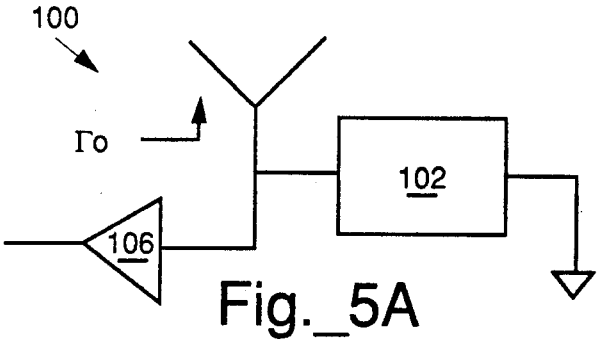
FIGS. 5A and 5B are block diagrams of two examples of a filtered pre-amplifier, according to the present invention.
Figure 5B:
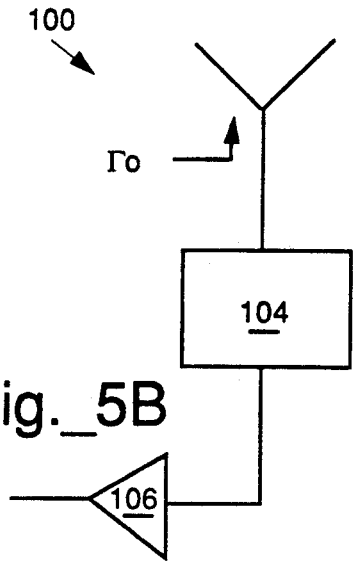
Figure 6:
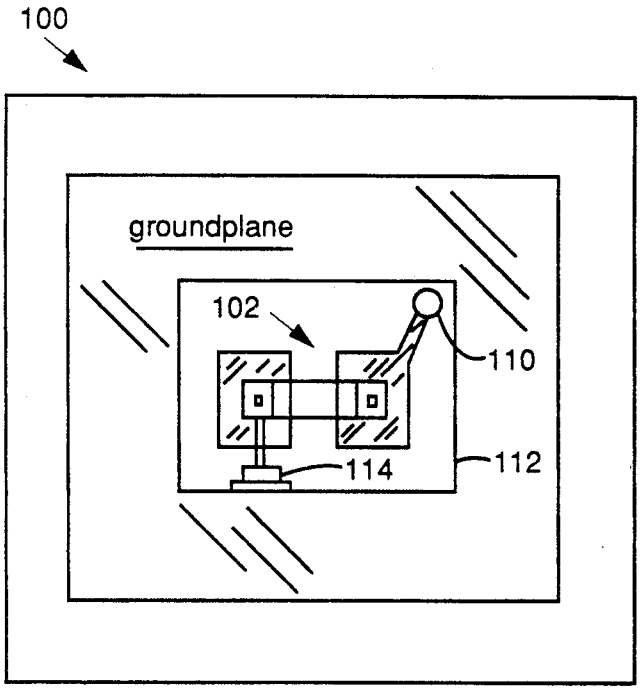
FIG. 6 is a bottom, groundplane view of an antenna pre-amplifier with the filter of FIGS. 5A.

In FIGS. 5A and 5B, a pre-amplified antenna 100 is shown with a bandstop filter 102 in FIG. 5A and with a band-pass filter 104 in FIG. 5B. An active stage 106 outputs received signals to an external receiver. The construction of antenna 100 is similar to that of antenna 70. Groundplane relief 84 is used to house filter 102 or 104, or both. FIG. 6 shows an example of how a filter, such as filters 102 and 104 would be mounted in the groundplane relief of an antenna like antenna 100. The filters can be Pi-network or T-network types, depending on the frequencies being filtered and the bandwidths (or "Q") required. Such filters are conventional, an example of which is described in U.S. Pat. No. 4,881,050, issued Nov. 14, 1989 to Swanson, Jr. There, a filter is fabricated from a planar dielectric substrate having a ground plane on one side and two thin-film metal layers and an insulation layer on the other side. The metal and insulation layers are configured to form one or more capacitive pi-networks and spiral inductors, and are electrically interconnected to form the filter. A via 110 connects to a radiator (not shown) in the manner described above in the previous embodiments. Active stage 106 can be located either inside the groundplane relief with the filter, or outside. FIG. 6 shows only filter 102 within a groundplane relief 112, but filter 104 and/or active stage 106 could be located there as well, and with the advantages previously described. Output is through a cable 114. A lid (not shown), which is similar to lid 86 (FIG. 4B), is preferably used to seal groundplane relief 112.

Figure 7:
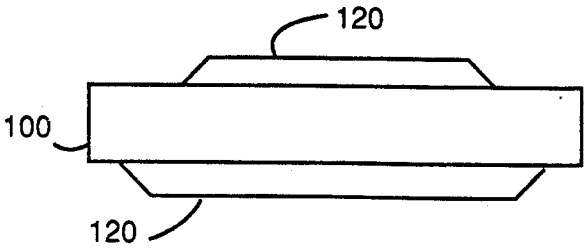
FIG. 7 is an edge view of the pre-amplifier of FIGS. 5A and 6 with shields attached.

FIG. 7 shows how at least one shield 120 can be attached to an antenna, such as antenna 100, to shape the radio radiation pattern of antenna 100. The shield(s) 120 can be either rectangular or circular in shape, depending on which one or which combination gives the best shape, according to a predetermined requirement. Shield(s) 120 can act as radio wave directors and reflectors, depending on their geometry and the distance to the radiator (e.g., radiator 62. In conventional Yagi antenna design, for example, isolated passive director elements are made slightly shorter than the active elements, and tend to increase the radiation pattern lobe in the direction of the director and decrease it in the opposite direction. Reflector elements are slightly longer than the active elements, and tend to decrease the radiation pattern lobe in the direction of the reflector and increase it in the opposite direction. Directors and reflectors can be used simultaneously to produce, for example, highly directional patterns. The ratios of the X-Y dimensions in the dipole microstrip reflectors and directors (shields 120) need not repeat that of the main radiator (e.g., "A" and "B" for radiator 62). Manipulation of these respective dimensions can be done to achieve shapes that are different in the X and Y planes.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A microstrip antenna system, comprising:

a flat dielectric substrate having a pair of opposite first and second sides;

a high-gain, low-noise transistor mounted to the dielectric substrate on said first side and having a first port impedance;

a groundplane electrode disposed on said first side of the dielectric substrate and including an opening for surrounding the transistor;

a rectangularly-shaped, diagonally-fed dipole antenna radiating electrode disposed on said second side of the dielectric substrate and opposite to the transistor and groundplane electrode; and an inductive connection between the transistor and the radiating electrode at a critical diagonal feeding point on the radiating electrode that matches said first port impedance, wherein the inductive connection has an inductance value and makes connection to said critical point on the radiating electrode that is equivalent to a predetermined impedance Zo and a noise figure minimum, with respect to the transistor.

2. The antenna system of claim 1, further comprising:

a cavity in said first side of the dielectric substrate in which the transistor is disposed; and an output matching network for coupling the transistor to an external system.

3. The antenna system of claim 2, wherein:

the output matching network is such that said external system comprises a GPS receiver; and the transistor has an input connected to the inductive connection wherein GPS signals received by the radiating electrode may be amplified by the transistor and output through the output matching network.

4. The antenna system of claim 2, wherein:

the dielectric substrate is a flat round disk;

said external system is a transmitter; and the transistor has an output connected to the inductive connection.

5. The antenna system of claim 2, wherein:

said external system is a GPS receiver; and said predetermined impedance is substantially equal to the port impedance of the transistor.

6. The antenna system of claim 2, further comprising:

a conductive lid that covers the cavity and that electrically connects along its perimeter to the groundplane electrode, wherein an electrical opening in the groundplane electrode that was created by the cavity is thereby closed over the transistor.

7. The antenna of claim 2, further comprising:

a band stop filter disposed within said cavity and connected to said inductive connection and the groundplane electrode.

8. The antenna of claim 2, further comprising:

a band pass filter disposed within said cavity and connected in series with said inductive connection and the transistor.

9. The antenna of claim 1, further comprising:

at least one shield electrode that modifies and shapes in a predetermined way a radio beam radiation pattern associated with the antenna.

10. The antenna of claim 9, wherein:

the shield electrode is rectangular in shape.

11. The antenna of claim 9, wherein:

the shield electrode is circular in shape.

* * * * *